US009033025B2

(12) United States Patent
Forde et al.

(10) Patent No.: US 9,033,025 B2
(45) Date of Patent: May 19, 2015

(54) ALUMINIUM-COPPER ALLOY FOR CASTING

(75) Inventors: John Forde, London (GB); William Stott, London (GB)

(73) Assignee: AEROMET INTERNATIONAL PLC, London (GB)

( * ) Notice: Subject to any disclaimer, the term of this patent is extended or adjusted under 35 U.S.C. 154(b) by 0 days.

(21) Appl. No.: 13/578,215

(22) PCT Filed: Feb. 10, 2011

(86) PCT No.: PCT/GB2011/050240

§ 371 (c)(1), (2), (4) Date: Nov. 29, 2012

(87) PCT Pub. No.: WO2011/098813

PCT Pub. Date: Aug. 18, 2011

(65) Prior Publication Data

US 2013/0068411 A1 Mar. 21, 2013

(30) Foreign Application Priority Data

Feb. 10, 2010 (GB) ..... 1002236.6

(51) Int. Cl.

| | |
|---|---|
| ***B22C 9/00*** | (2006.01) |
| ***B22C 21/10*** | (2006.01) |
| ***C22C 21/12*** | (2006.01) |
| ***C22C 21/00*** | (2006.01) |
| ***C22C 21/06*** | (2006.01) |
| ***C22C 1/10*** | (2006.01) |
| ***C22C 21/14*** | (2006.01) |
| ***C22C 21/16*** | (2006.01) |
| ***C22C 21/18*** | (2006.01) |
| ***B22D 25/00*** | (2006.01) |
| ***B22D 27/04*** | (2006.01) |

(52) U.S. Cl.

CPC ..... *C22C 21/12* (2013.01); *C22C 1/1068* (2013.01); *C22C 21/00* (2013.01); *C22C 21/14* (2013.01); *C22C 21/16* (2013.01); *C22C 21/18* (2013.01); *B22D 25/00* (2013.01); *B22D 27/04* (2013.01)

(58) Field of Classification Search

USPC ..... 164/376, 349; 420/529, 532, 533

See application file for complete search history.

(56) References Cited

U.S. PATENT DOCUMENTS 3,475,166 A * 10/1969 Raffin ..... 420/532
4,943,490 A 7/1990 Bruski et al.

(Continued)

FOREIGN PATENT DOCUMENTS

EP 0861911 9/1998
EP 0940475 9/1999

(Continued)

OTHER PUBLICATIONS

Search Report, dated Apr. 20, 2012, corresponding to International Application No. PCT/GB2011/050240 (filed Feb. 10, 2011), 7 pp.

(Continued)

*Primary Examiner* — Keith Walker
*Assistant Examiner* — Steven Ha
(74) *Attorney, Agent, or Firm* — Lathrop & Gage LLP

(57) ABSTRACT

An aluminium-copper alloy comprising substantially insoluble particles which occupy the interdendritic regions of the alloy, provided with free titanium in quantity sufficient to result in a refinement of the grain structure in the cast alloy.

21 Claims, 6 Drawing Sheets

(56) References Cited

U.S. PATENT DOCUMENTS

| | | | | |
|---|---|---|---|---|
| 5,462,712 | A | 10/1995 | Langan et al. | |
| 5,523,050 | A | 6/1996 | Lloyd et al. | |
| 5,989,495 | A | 11/1999 | Isayama et al. | |
| 6,126,898 | A * | 10/2000 | Butler | 420/529 |
| 6,290,748 | B1 | 9/2001 | Jha et al. | |
| 2008/0060723 | A1 * | 3/2008 | Doty | 148/549 |
| 2008/0299001 | A1 | 12/2008 | Langlais et al. | |
| 2009/0252643 | A1 | 10/2009 | Doty et al. | |

FOREIGN PATENT DOCUMENTS

| | | |
|---|---|---|
| GB | 1333957 | 10/1973 |
| GB | 2334966 | 9/1999 |
| JP | 59219444 | 5/1983 |
| JP | 04-120237 | 4/1992 |
| JP | 09-296245 | 11/1997 |
| JP | 11199960 | 7/1999 |
| WO | 87/06624 | 11/1987 |
| WO | 93/05189 | 3/1993 |
| WO | 2008/072972 | 6/2008 |

OTHER PUBLICATIONS

Dupouy et al. (Jan. 1, 1998) "Experimental Study of the Columnar to Equiaxed Transition in a Refined AL-4WT% CU Alloy Under Diffusive Transport Conditions," Modeling of Casting, Welding and Advanced Solidification Processes—VIII, Proceedings of the Eighth Internatl. Conference on Modeling of Casting and Welding Processes, San Diego, CA, Jun. 7-12, 1998, Minerals,. Metals & Materials Society, pp. 415-423.

Hecht et al. (Mar. 1, 1997) "On the Transition from Pushing to Engulfment During Directional Solidification of the Particle-Reinforced Aluminum-Based Metal-Matrix Composite 2014 + 10 Vol Pct $AL_20_3$," Metallurgical and Materials Transactions A: Physical Metallurgy & Materials Science, ASM Internatl., Materials Park, OH, US, 28A:867-874.

Kennedy et al. (Feb. 13, 1995) "Homogeneous Metal Matrix Composites Produced by a Modified Stir-Casting Technique," Synthesis/Processing of Lightweight Metallic Materials, Proceedings of a Symposium, pp. 261-274.

Lapin et al. (Nov. 1, 1999) "Microstructure and Mechanical Properties of Wrought Aluminum Alloy Prepared by Recycling of Aluminum Matrix Composites Reinforced with Inconel 601 Fibres," Materials Science and Engineering A: Structural Materials: Properties, Microstructure & Processing, Lausanne, CH, A271(1-2):266-274.

Third Party Observations According to Art. 115 EPC for EP Application 2 534 273, Apr. 25, 2014.

Third Party Observations According to Art. 115 EPC for EP Application 2 534 273, Jul. 2, 2014.

Pedro Egizabal Luzuriaga, Ph D Thesis, "Influence of Titanium Diboride ($TiB_2$) particles on the microstructure and properties of reinforced Al-Si7Mg0.3 and Al-Cu5MgTi alloys for plaster casting applications", L'Universite Bordeaux, published Jul. 2007.

J.G. Kaufman and Elwin L. Rooy, "Aluminium Alloy Castings: Properties, Processes, and Applications," ASM International, Dec. 2004, pp. 7-17.

Japanese Office Action, dated Dec. 2, 2014, in Japanese Patent Application No. P2012-552470, 10 pp.

* cited by examiner

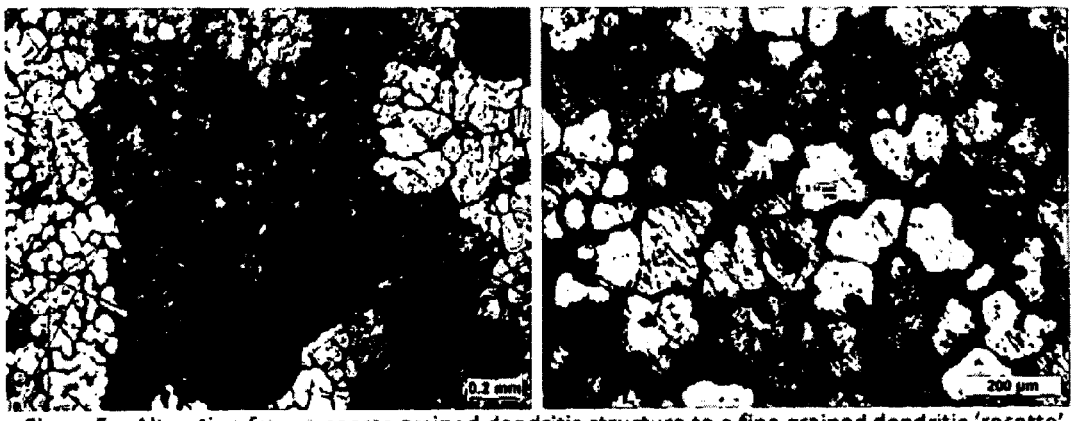
Figure 5a: Alteration from a coarse grained dendritic structure to a fine grained dendritic 'rosette' structure. Images obtained from cooling curve experiments
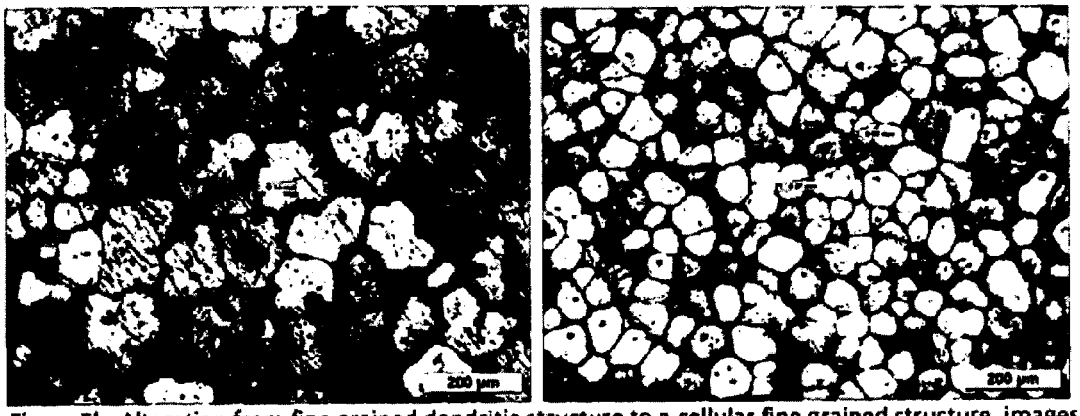
Figure 5b: Alteration from fine grained dendritic structure to a cellular fine grained structure, images obtained from cooling curve experiments

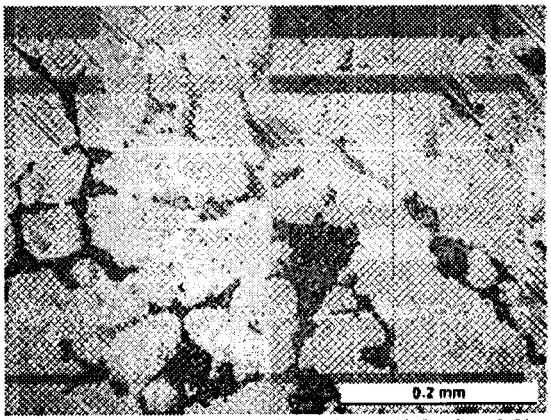
Figure 6a: Microstructure of the alloy at low wt% titanium 0.02wt%
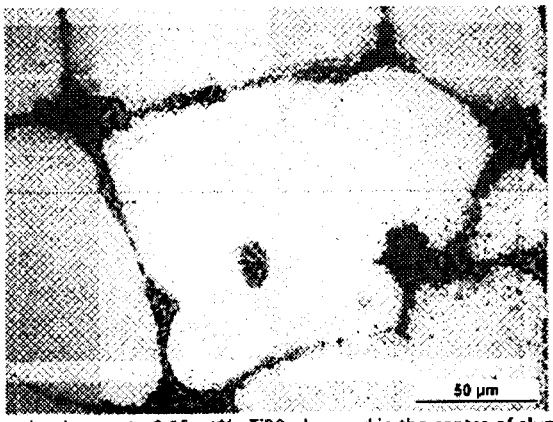
Figure 6b: Free titanium up to 0.15 wt% , TiB2 observed in the centre of aluminium grains
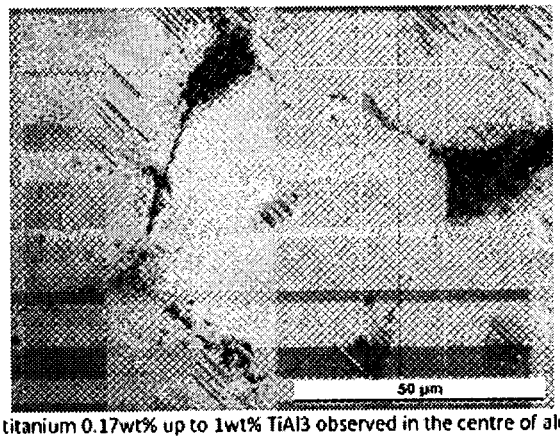
Figure 6C Free titanium 0.17wt% up to 1wt% TiAl3 observed in the centre of aluminium grains

The addition of titanium allows for a wide range of as cast grain sizes dependent on cooling rate

Exceptionally fine grained structure achievable when cool cooling rate is extremely high

ALUMINIUM-COPPER ALLOY FOR CASTING

CROSS-REFERENCE TO RELATED APPLICATIONS

This application is a U.S. National Stage Application filed under 35 U.S.C. §371 of International Application No. PCT/GB2011/050240, filed Feb. 10, 2011, which claims the benefit of Great Britain Application No. 1002236.6, filed Feb. 10, 2010. Both of these applications are hereby incorporated by reference in their entireties.

DESCRIPTION OF INVENTION

This invention relates to aluminium-copper alloys for casting. Aluminium-copper alloys have a potentially higher strength than other cast aluminium alloy systems such as aluminium-silicon alloys. However, the use of aluminium-copper alloys for high performance applications has been limited due to their relatively poor castability compared to aluminium-silicon alloys.

UK patent application 2334966A discloses an aluminium-copper alloy in which substantially insoluble particles, preferably of titanium diboride or possibly of other materials such as silicon carbide, aluminium oxide, zirconium diboride, boron carbide, or boron nitride, occupy interdendritic regions of the alloy when it is cast. It would be expected that such particles, which normally are hard and brittle, would result in an unacceptable reduction in the ductility of the cast alloy, but in fact research has shown that good ductility is maintained, as the particles change the solidification characteristics of the alloy, eliminating macro-scale compositional inhomogeneity and reducing shrinkage porosity. During solidification of the alloy, the $TiB_2$ particles fill the interdendritic spaces as aluminium dendrites nucleate and begin to grow, and the presence of the $TiB_2$ particles restricts the movement of the remaining liquid metal through the interdendritic channels. This promotes a move towards mass feeding, which reduces the occurrence of both internal and surface connected shrinkage porosity. However, even though $TiB_2$ is a known grain refiner, the grain size remains very large (e.g. circa 1 mm). This unrefined grain structure can result in issues with hot tearing, particularly in sand castings, and can also lead to the formation of shrinkage porosity in large slow-cooled castings such as those produced by investment casting or sand casting.

JP 11199960 discloses an aluminium alloy suitable for making engine cylinder head castings, which may contain titanium. However, the alloy is an aluminium-silicon alloy: such alloys fundamentally have much greater fluidity and castability than alloys containing little or no silicon, and do not suffer from the same level of hot tearing or shrinkage porosity as the latter alloys.

In accordance with a first aspect of the invention, an aluminium-copper alloy comprising substantially insoluble particles which occupy the interdendritic regions of the alloy is provided with free titanium, to the extent that in combination with the insoluble particles results in a further refinement of the grain structure in the cast alloy, and facilitates a consequent improvement in both the castability and the physical properties thereof.

The alloy may comprise at least 0.01% titanium

The alloy may comprise up to 1% titanium

The alloy may comprise up to 0.50% titanium

The alloy may comprise up to 0.15% titanium (hypoperitectic)

The alloy may comprise more than 0.15% titanium (hyperperitectic)

The alloy may comprise:

| | |
|---|---|
| Cu | 3.0-6.0% |
| Mg | 0.0-1.5% |
| Ag | 0.0-1.5% |
| Mn | 0.0-0.8% |
| Fe | 0.0-1.5% max |
| Si | 0.0-1.5% max |
| Zn | 0.0-4.0% |
| Sb | 0.0-0.5% |
| Zr | 0.0-0.5% |
| Co | 0.0-0.5% |
| Ti | 0.01-1.0% |
| Insoluble particles | up to 20% |
| Al and inevitable impurities | Balance |

The insoluble particles may have a particle size of 0.5 μm or greater. It may be up to 25 μm. Preferably, the particle size may be up to 15 μm, or up to 5 μm. The insoluble particles may be present at least 0.5%, possibly up to 20%.

The alloy may comprise:

| | |
|---|---|
| Cu | 4.0-5.0% |
| Mg | 0.2-0.5% |
| Ag | 0.0-0.5% |
| Mn | 0.0-0.6% |
| Fe | 0.0-0.15% |
| Si | 0.0-0.15% |
| Zn | 0.0-1.8% |
| Sb | 0.0-0.5% |
| Zr | 0.0-0.5% |
| Co | 0.0-0.5% |
| Ti | 0.01-1.0% |
| Insoluble particles | up to 10% |
| Al and inevitable impurities | Balance |

The alloy may comprise:

| | |
|---|---|
| Cu | 4.0-5.0% |
| Mg | 0.2-0.5% |
| Ag | 0.4-1.0% |
| Mn | 0.0-0.6% |
| Fe | 0.0-0.15% |
| Si | 0.0-0.15% |
| Zn | 0.0-1.8% |
| Sb | 0.0-0.5% |
| Zr | 0.0-0.5% |
| Co | 0.0-0.5% |
| Ti | 0.01-1.0% |
| Insoluble particles | up to 10% |
| Al and inevitable impurities | Balance |

The insoluble particles may be present in the range 0.5% to 10%, or 1.5% to 9%, or 3% to 9%, or 4% to 9%.

The alloy may comprise:

| | |
|---|---|
| Cu | 4.2-5.0% |
| Mg | 0.2-0.5% |
| Ag | 0.0-0.85% |
| Mn | 0.0-0.4% |
| Fe | 0.0-0.15% |
| Si | 0.0-0.15% |
| Zn | 0.0-1.8% |
| Sb | 0.0-0.5% |
| Zr | 0.0-0.5% |

-continued

| | |
|---|---|
| Co | 0.0-0.5% |
| Ti | 0.01-1.0% |
| Insoluble particles | 1.5-9.0% |
| Al and inevitable impurities | Balance |

The alloy may comprise:

| | |
|---|---|
| Cu | 4.2-5.0% |
| Mg | 0.2-0.5% |
| Ag | 0.0-0.85% |
| Mn | 0.0-0.4% |
| Fe | 0.0-0.15% |
| Si | 0.0-0.15% |
| Zn | 0.0-1.8% |
| Sb | 0.0-0.5% |
| Zr | 0.0-0.5% |
| Co | 0.0-0.5% |
| Ti | 0.01-1.0% |
| Insoluble particles | 4.0-9.0% |
| Al and inevitable impurities | Balance |

The alloy may comprise:

| | |
|---|---|
| Cu | 4.2-5.0% |
| Mg | 0.2-0.5% |
| Ag | 0.45-0.85% |
| Mn | 0.0-0.4% |
| Fe | 0.0-0.15% |
| Si | 0.0-0.15% |
| Zn | 0.0-1.8% |
| Sb | 0.0-0.5% |
| Zr | 0.0-0.5% |
| Co | 0.0-0.5% |
| Ti | 0.01-1.0% |
| Insoluble particles | 1.5-9.0% |
| Al and inevitable impurities | Balance |

The alloy may comprise:

| | |
|---|---|
| Cu | 4.2-5.0% |
| Mg | 0.2-0.5% |
| Ag | 0.45-0.85% |
| Mn | 0.0-0.4% |
| Fe | 0.0-0.15% |
| Si | 0.0-0.15% |
| Zn | 0.0-1.8% |
| Sb | 0.0-0.5% |
| Zr | 0.0-0.5% |
| Co | 0.0-0.5% |
| Ti | 0.01-1.0% |
| Insoluble particles | 4.0-9.0% |
| Al and inevitable impurities | Balance |

The insoluble particles may be of a size which is at least in the region of an order of magnitude smaller than the dendrite arm spacing/grain size of the solid alloy and occupy the interdendritic/intergranular regions of the alloy.

The particles may comprise titanium diboride particles.

The alloy may comprise 0.5%-20% titanium diboride particles.

The alloy may comprise 0.5%-10% titanium diboride particles.

The alloy may comprise 3%-7% titanium diboride particles.

The alloy may comprise 4% titanium diboride particles.

The alloy may comprise 7% titanium diboride particles.

Two of the major aspects that have been identified as factors which lead to variability of mechanical properties and structural integrity in aluminium-copper based alloys, are the segregation of alloying elements and the formation of interdendritic porosity particularly that which is surface connected.

Research on cast aluminium copper alloys has indicated that a significant factor contributing to the variability of the material properties of such alloys is the flow of solute rich material through the interstices between the dendrite arms created during solidification.

In order to prevent or reduce these phenomena occurring, additions of finely divided substantially insoluble particles have been made in accordance with the invention. It would normally be expected that the addition of such particles, which are normally hard and brittle, would result in an unacceptable reduction in the ductility of the alloy. However the research carried out has shown that good ductility is maintained as will be seen from the example set out below.

Dispersed interdendritic porosity is also a characteristic of these alloys due to problems of feeding solidification shrinkage through the dendrite interstices. This type of porosity also causes a reduction in the mechanical properties of the material i.e. tensile strength and elongation and fatigue life.

It will be appreciated that, in the present invention, the addition of finely divided substantially insoluble particles changes the solidification characteristics of the alloy and they are not applied as a direct hardening mechanism for the alloy. The further addition of titanium at varying levels results in a significant reduction in grain size and further alters these solidification mechanisms, in the manner described hereafter.

According to another aspect of this invention, we provide a method of making a casting comprising the step of melting aluminium copper alloy comprising:

| | |
|---|---|
| Cu | 4.0-5.0% |
| Mg | 0.2-0.5% |
| Ag | 0.0-1.0% |
| Mn | 0.0-0.6% |
| Fe | 0.0-0.15% |
| Si | 0.0-0.15% |
| Zn | 0.0-1.8% |
| Sb | 0.0-0.5% |
| Zr | 0.0-0.5% |
| Co | 0.0-0.5% |
| Ti | 0.01-1.0% |
| Al and inevitable impurities | Balance |

With 0.5-10% insoluble particles, and pouring the resulting alloy into a mould.

According to another aspect of the invention we provide a casting made from an alloy, or by a process, of this invention.

The invention will now be described by way of example with reference to the accompanying drawings, wherein.

Figures 4A, 4B, 4C:
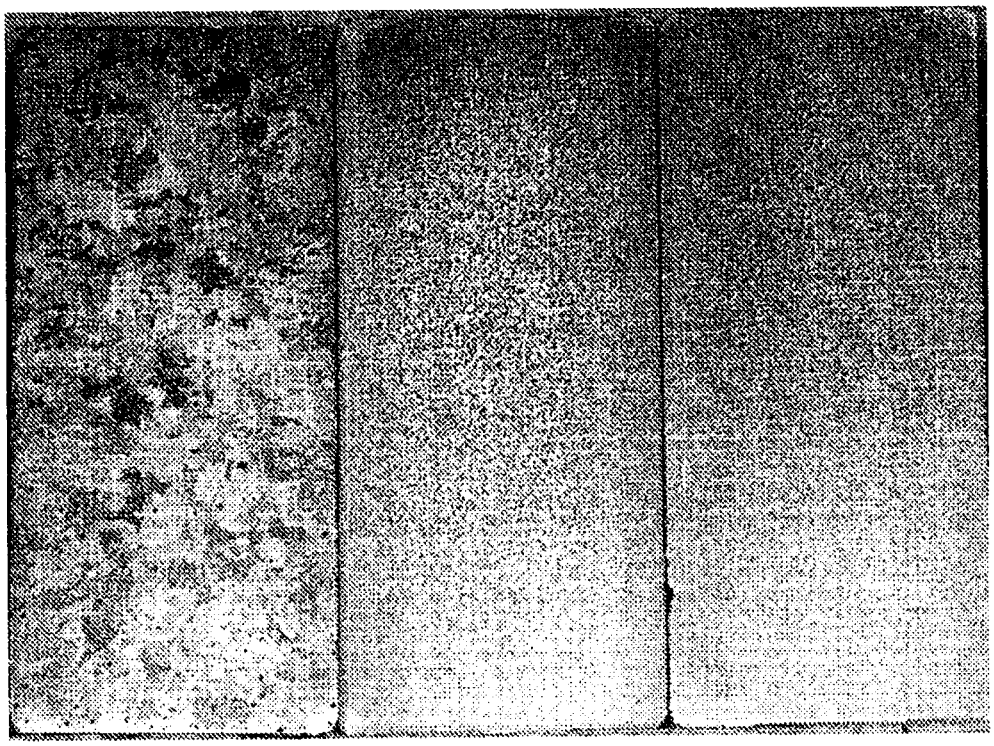

FIG. 4*a, b, c* are macroscopic images showing the reduction in grain size with increasing titanium levels 0.02 wt %*, 0.15 wt %*, 0.44 wt %*.

FIGS. 5*a* and 5*b* are optical microscope image showing the alteration in microstructure with increasing titanium weight % 0.02 wt %*, 0.15 wt %*, and 0.44 wt % *.

FIG. 6*a, b, c* respectively illustrate, on an enlarged scale, the micro structure of alloys with increasing amounts of titanium.

Figure 7A:
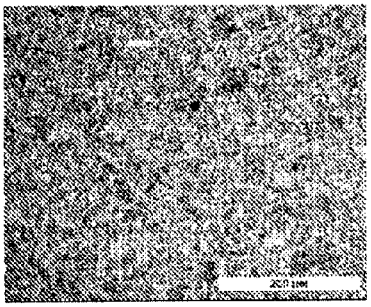

FIG. 7*a, b* illustrate the effect on micro structure achieved by controlling the cooling rate of castings.

Note* All quoted weight percentages in this section are measured figures and so are subject to standard error. Compositional analysis was performed by inductively coupled plasma optical emission spectroscopy and is subject to a standard error of ±2% on the achieved figure According to the invention an alloy comprising*:

| | |
|---|---|
| Cu | 4.35% |
| Mg | 0.42% |
| Ag | 0.70% |
| Mn | 0.01% |
| Fe | 0.01% |
| Si | 0.07% |
| Zn | 0.01% |
| Ti | 0.02% |
| $TiB_2$ | 4.80% |

Denoted Alloy A was cast in a conventional manner.

Figure 1:
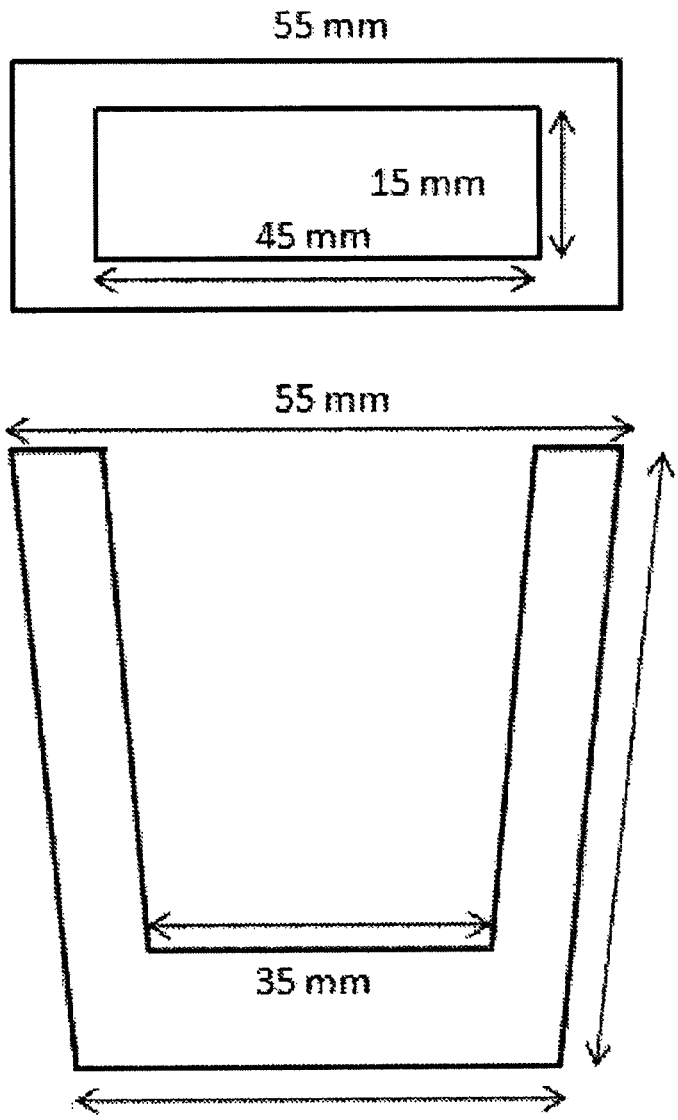
FIG. 1 is a diagrammatic view of the test-piece casting mould.
Figure 2:
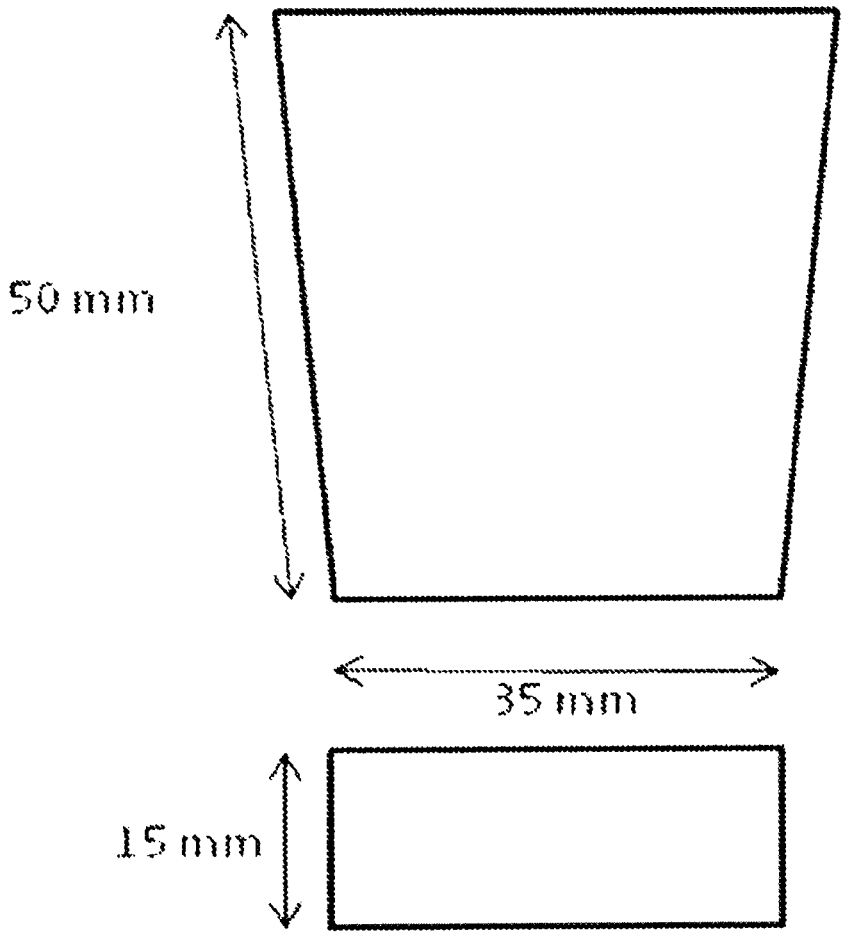
FIG. 2 is a diagrammatic view of the resultant casting.
Figure 3:
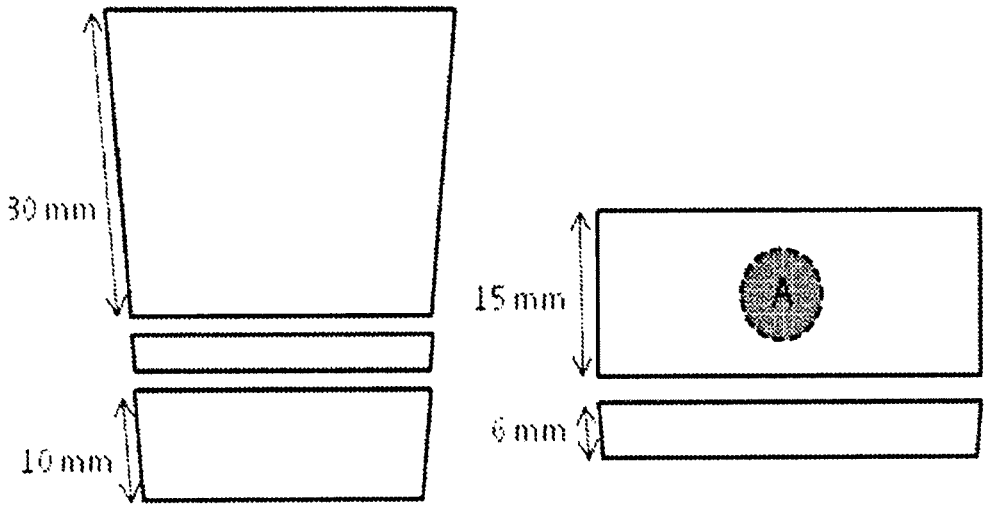
FIG. 3 is a schematic of the resultant casting when sectioned for microscopic examination.

The alloy was cast into a resin bonded sand mould; the mould configuration is detailed in FIG. 1. The test piece was poured directly from the crucible at a temperature of 850 deg C. and the resultant casting was allowed to solidify in air. The resultant casting, FIG. 2, was sectioned as described in FIG. 3 and surface A, marked on FIG. 3, was ground utilising silicon carbide grinding paper 120-1200 grit and polished using diamond compound and colloidal silica. The resultant surface was then etched using Kellers reagent and imaged using an optical macroscope and microscope.

Alloys of similar composition comprising*

| | |
|---|---|
| Cu | 4.29% |
| Mg | 0.49% |
| Ag | 0.75% |
| Mn | 0.0% |
| Fe | 0.01% |
| Si | 0.05% |
| Zn | 0.01% |
| Ti | 0.15% |
| $TiB_2$ | 4.89% |

Denoted alloy B and

| | |
|---|---|
| Cu | 4.42% |
| Mg | 0.26% |
| Ag | 0.78% |
| Mn | 0.01% |
| Fe | 0.01% |
| Si | 0.04% |
| Zn | 0.01% |
| Ti | 0.44% |
| $TiB_2$ | 4.58% |

Denoted alloy C were made in a similar manner and in accordance with the invention As can be seen from the above compositions, these alloys, in accordance with the invention, contained between 1-9% titanium diboride particles. These particles had a size lying in the range 0.5-15 microns. In the above example the grain size of the alloy was found to lie between 40 and 200 μm and the titanium diboride particle size lay in the range 0.5-15 μm; thus the particles were approximately an order of magnitude smaller than the grain size. When the three castings are compared on both a macro scale and a micro scale the relative reduction in grain size with increasing titanium level is clearly observed.

FIG. 4*a* shows, on a macro scale, the grain structure in the casting of alloy A. FIG. 4*b* shows, on the same scale, the grain structure of the casting of alloy B, and FIG. 4*c* shows the grain structure in the casting of alloy C. The relative reduction in grain size with increasing titanium level is clearly visible. FIGS. 5*a*, and 5*b* illustrate the grain structure achieved in the three alloys, on a microscale.

Alloy A, containing 0.02%* titanium exhibits an relatively equiaxed coarse grained dendritic structure, see FIG. 5*a*.

Alloy B containing 0.15%* titanium exhibits a grain refined structure with some primary dendrite arms still visible, see FIG. 5*b*.

Alloy C containing 0.44%* titanium exhibits a fully grain refined homogenous structure, see FIG. 5*b*.

This effect of increasing titanium weight % has an effect on the solidification mechanisms and solidified structure of the alloy . These altered solidification mechanisms occur due to the interaction of enhanced grain refinement (a result of activated TiB2 and or $TiAl_3$), and inactive 'pushed' TiB2 particles. This interaction results in a vastly reduced tendency for the alloy to hot-tear, a minimised cooling-rate effect on grain size and consequently more consistent mechanical properties across sections of varying thickness, improved surface finish, and, it also allows for a significant reduction in the level of feed metal required to yield a sound casting.

The addition of free titanium affects the alloy in two ways, depending on the quantity of titanium added.

Firstly, additions of titanium below 0.15 wt % are in the hypoperitectic region; this means that below this level $TiAl_3$ particles will not form in the aluminium melt. However grain nucleation theory suggests that at hypoperitectic levels an atomically thin layer, similar in structure to $TiAl_3$ forms on the surface of $TiB_2$ particles, and this facilitates the nucleation of α-aluminium. It is by this mechanism that the addition of $TiB_2$ to aluminium melts results in grain refinement, as the $TiB_2$ particles act as heterogeneous nucleation sites for α-aluminium grains. The efficiency of these particles is thought to be in the region of 1-2% thus only a relatively small number of particles actually initiate a grain; the remaining particles are pushed to the grain boundaries by the growing aluminium grains.

Thus, in an alloy in according with the invention, the addition of hypoperitectic levels of titanium to the melt essentially activates the $TiB_2$ particles present in the alloy. Rather than the $TiB_2$ particles solely being utilised to affect liquid metal flow they serve the dual purpose of refining the grain structure of the alloy while also influencing the liquid metal flow and feeding mechanisms. Where $TiB_2$ is added purely as a grain refiner the addition level is as low as 0.004 wt % and even at these levels, the efficiency of nucleation is 1-2%. In an alloy according to the invention, the $TiB_2$ levels may be higher, thus there is a vast quantity of $TiB_2$ particles that remain inactive and these particles are pushed by the growing grains to the intergranular regions during solidification. This particle pushing coupled with the grain refinement observed from the addition of hypoperitectic levels of titanium results in significant benefits, as follows:

A finer grain size results in smaller more uniform individual cell units and on solidification this facilitates the move to mass feeding observed in the alloy. Aluminium alloys contract on solidification; this is normally facilitated by liquid metal flow through the interdendritic regions, and areas which cannot be fed by liquid metal on contraction form voids known as shrinkage pores. The mass feeding principle works on the basis that due to the presence of the $TiB_2$ particles in the interdendritic regions there is enough resistance to liquid metal flow that the alloy is forced to feed by bulk movement of the liquid/solid/particle agglomeration. This can only occur over a sustained period if the distribution of the particles is very homogenous which can only be guaranteed if the grain size is small and uniform.

This dual use of the $TiB_2$ particles as both a grain refiner and solidification/feeding modifier significantly improves the resistance to shrinkage porosity and hot tearing and also gives a more homogenous as cast structure The homogenous distribution of $TiB_2$ particles throughout the solidified structure also allows for more consistent mechanical properties and the retention of elongation. A fine grain structure allows the $TiB_2$ to be widely and evenly distributed throughout the solidified structure, if this was not the case then the $TiB_2$ particles would cluster together and as a brittle ceramic would facilitate crack growth through the alloy reducing ductility significantly.

The change from dendritic feeding to mass feeding has very important implications in terms of component running system design and feeding. One of the greatest issues with previously known aluminium-copper alloys is that in order to get a sound casting the casting must be fed with a large amount of liquid feed metal, and as a consequence material yields are very low. This impacts heavily on the cost effectiveness of the alloy, with large quantities of virgin metal being melted to yield relatively small components. The move to mass feeding allows for large reductions in feeding requirements which improves efficiency in terms of material usage and energy input per casting.

However at this concentration of titanium grain refinement was found to be highly cooling rate dependent. Grain coarsening can occur in slow-cooled regions with the cellular structure becoming more globular and dendrite-like, this can negatively affect the alloy making it more susceptible to issues such as hot tearing and also negating the reduced feed metal requirements. Hence an alloy according to the invention with this Ti range is most suitable for rapidly cooled systems; for example die casting.

Above 0.15 wt % free titanium the alloy becomes hyperperitectic with regard to the titanium content. Above this level $TiAl_3$ particles can form in the aluminium melt. The addition of hyperperitectic levels of titanium to the alloy results in a further unexpected decrease in grain size and further extremely important alterations to material solidification behaviour. Typically the addition of hyperperitectic levels of titanium to an alloy already containing 4-5 wt % $TiB_2$ would be expected to have little further effect on grain refinement, but in accordance with the invention it was found that not only did the combined effects of both $TiB_2$ and the $TiAl_3$ reduce grain size it also had a significant effect on the solidification and feeding mechanisms, with resultant improvements in castability.

The addition of titanium in this hyperperitectic region allows for the formation of $TiAl_3$ particles, which form in the aluminium melt well above the liquidus. $TiAl_3$ has been shown to be a more potent grain refiner than $TiB_2$, thus in the liquid metal prior to solidification there is a vast number of $TiAl_3$ particles suspended along with $TiB_2$ particles. On solidification the $TiAl_3$ particles rapidly nucleate a very large number of aluminium grains, grain growth is inhibited by the $TiB_2$ particles as they are pushed to the grain boundaries. As with $TiB_2$ not every $TiAl_3$ particle will nucleate a grain, however unlike $TiB_2$ the $TiAl_3$ particles are engulfed by the advancing growth front rather than pushed, this is critical in maintaining alloy ductility. The formation of $TiAl_3$ in the melt results in a further reduction in grain size when compared to the hypoperitectic titanium addition and allows extremely fine grains to be formed at high cooling rates. However more importantly it enables the formation of highly grain refined structures even in slow cooled sections. The grain refinement is still a function of cooling rate but the high level of grain refinement means that even at slow cooling rates the grain size is fine enough to allow for mass feeding to occur. Thus, with the addition of hyperperitectic titanium not only can the gains observed previously in the hypoperitectic alloy be carried over to both sand and investment casting techniques, they actually facilitate further savings in terms of feed metal, resulting in increases in material yield and increases in material and energy efficiency.

The above effects on grain structure are illustrated in FIGS. 5*a, b* and *c*, and also in FIG. 6. FIG. 6*a* illustrates the microstructure of the alloy at very low wt % free titanium although the structure is equiaxed and shows some evidence of grain refinement the level of refinement is very low. FIG. 6*b* shows the hypoperitectic micro-structure with up to 0.15 wt % of free titanium. In FIG. 6*b* $TiB_2$ can be observed in the centre of the aluminium grains and there are no aluminide particles present indicating that the alloy is below the peritectic threshold. FIG. 6*c* shows that from 0.15 wt % titanium up to 1.0 wt % titanium, $TiAL_3$ can be observed in the centre of the aluminium grains indicating that the titanium level is above the peritectic threshold and the aluminides are now acting as nucleating particles.

Figure 7B:
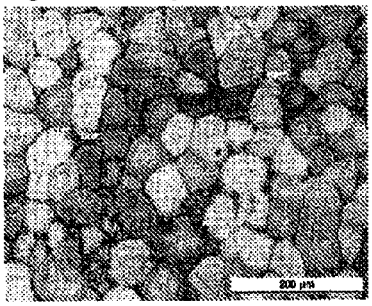

The addition of titanium allows for a wide range of as-cast grain sizes dependent on cooling rate. FIGS. 7*a* and 7*b* respectively illustrate, in FIG. 7*a*, an exceptionally fine-grain structure which can be achieved when the cooling rate is extremely high, while FIG. 7*b* illustrates a coarser grain structure when the cooling rate is lower; these alloys contain hyperperitectic levels of titanium.

In general, as explained above the amount of free titanium necessary to refine the grain structure in the cast alloy and facilitate the move to mass feeding is related to the cooling rate of a casting made from the alloy. In general, for castings of comparable size to one another, conventional sand casting and investment casting require titanium levels above the peritectic threshold due to the inherently low cooling rates. However higher cooling rate casting processes such as die casting and heavily chilled sand casting can be grain refined using hypoperitectic levels of free titanium.

The magnification of the mass feeding phenomenon observed in the hyperperitectic titanium range allows for significant reductions in feed metal required to yield a sound casting. Typical aluminium alloys require large reservoirs of liquid metal to supply the solidifying and contracting casting; if an area is isolated from a supply of liquid metal, porosity forms to compensate for the volumetric change as the casting solidifies and contracts. If the structure is mass feeding and the casting becomes a coherent structure at a much earlier stage in the solidification process and if, throughout solidification, there is no interdendritic movement of liquid metal then there is very little likelihood of shrinkage porosity arising.

The practical result of this in the manufacture of casting is that the yield of a casting or castings from a given quantity of metal is greatly improved, i.e. the number of given components which can be cast from a particular quantity of metal is increased. This results in cost and energy savings, both in production of the castings and in post-casting processing of components.

In addition, the reduction in grain size and the transformation from a dendritic to a cellular structure results in a reduction of both surface-related and, critically, internal, shrinkage porosity. This directly affects the fatigue performance of components cast from the alloy, as porosity is one of the most detrimental factors to fatigue life. Pores act as initiation points in fatigue-loaded specimens, and also affect crack propagation and final failure, by acting as stress concentrators and by reducing the load-bearing area.

In this specification:

All compositions are expressed in percentage by weight: In the phrase "insoluble particles", by "insoluble" we mean particles which are at least substantially insoluble in the alloy; by "particles" we mean particles of metal, or of inter-metallic compound or of ceramic material. The particles may comprise, for example, titanium diboride or silicon carbide, aluminium oxide, zirconium diboride, boron carbide or boron nitride: Although only one specific alloy composition embodying the invention has been described above by way of example, other alloy compositions are referred to and claims herein, and an alloy embodying the invention may have an alloy composition, a particle composition, a particle size, a particle content etc as described in any part of this specification.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. An aluminium-copper alloy for casting, comprising substantially insoluble particles which occupy the interdendritic regions of the alloy, the substantially insoluble particles being present in an amount of at least 0.5 wt % up to 20 wt % and comprising titanium diboride particles, wherein the alloy comprises a hyperperitectic quantity of free titanium to result in a refinement of the grain structure in the cast alloy.

2. An alloy according to claim 1 comprising up to 1 wt % titanium.

3. An alloy according to claim 1 comprising up to 0.5 wt % titanium.

4. An aluminium-copper alloy according to claim 2, comprising:

| | |
|---|---|
| Cu | 3.0-6.0 wt % |
| Mg | 0.0-1.5 wt % |
| Ag | 0.0-1.5 wt % |
| Mn | 0.0-0.8 wt % |
| Fe | 0.0-1.5 wt % |
| Si | 0.0-1.5 wt % |
| Zn | 0.0-4.0 wt % |
| Sb | 0.0-0.5 wt % |
| Zr | 0.0-0.5 wt % |
| Co | 0.0-0.5 wt % |
| Ti | hyperperitectic |
| Insoluble particles | at least 0.5 wt % up to 20 wt % |
| Al and inevitable impurities | Balance. |

5. An alloy according to claim 2 comprising:

| | |
|---|---|
| Cu | 4.0-5.0 wt % |
| Mg | 0.2-0.5 wt % |
| Ag | 0.0-0.5 wt % |
| Mn | 0.0-0.6 wt % |
| Fe | 0.0-0.15 wt % |
| Si | 0.0-0.15 wt % |
| Zn | 0.0-1.8 wt % |
| Sb | 0.0-0.5 wt % |
| Zr | 0.0-0.5 wt % |
| Co | 0.0-0.5 wt % |
| Ti | hyperperitectic |
| Insoluble particles | at least 0.5 wt % up to 10 wt % |
| Al and inevitable impurities | Balance. |

6. An alloy according to claim 2 comprising:

| | |
|---|---|
| Cu | 4.0-5.0 wt % |
| Mg | 0.2-0.5 wt % |
| Ag | 0.4-1.0 wt % |
| Mn | 0.0-0.6 wt % |
| Fe | 0.0-0.15 wt % |
| Si | 0.0-0.15 wt % |
| Zn | 0.0-1.8 wt % |
| Sb | 0.0-0.5 wt % |
| Zr | 0.0-0.5 wt % |
| Co | 0.0-0.5 wt % |
| Ti | hyperperitectic |
| Insoluble particles | at least 0.5 wt % up to 10 wt % |
| Al and inevitable impurities | Balance. |

7. An alloy according to claim 2 comprising:

| | |
|---|---|
| Cu | 4.2-5.0 wt % |
| Mg | 0.2-0.5 wt % |
| Ag | 0.0-0.85 wt % |
| Mn | 0.0-0.4 wt % |
| Fe | 0.0-0.15 wt % |
| Si | 0.0-0.15 wt % |
| Zn | 0.0-1.8 wt % |
| Sb | 0.0-0.5 wt % |
| Zr | 0.0-0.5 wt % |
| Co | 0.0-0.5 wt % |
| Ti | hyperperitectic |
| Insoluble particles | 1.5-9.0 wt % |
| Al and inevitable impurities | Balance. |

8. An alloy according to claim 2 comprising:

| | |
|---|---|
| Cu | 4.2-5.0 wt % |
| Mg | 0.2-0.5 wt % |
| Ag | 0.0-0.85 wt % |
| Mn | 0.0-0.4 wt % |
| Fe | 0.0-0.15 wt % |
| Si | 0.0-0.15 wt % |
| Zn | 0.0-1.8 wt % |
| Sb | 0.0-0.5 wt % |
| Zr | 0.0-0.5 wt % |
| Co | 0.0-0.5 wt % |
| Ti | hyperperitectic |
| Insoluble particles | 4.0-9.0 wt % |
| Al and inevitable impurities | Balance. |

9. An alloy according to claim 2 comprising:

| | |
|---|---|
| Cu | 4.2-5.0 wt % |
| Mg | 0.2-0.5 wt % |
| Ag | 0.45-0.85 wt % |
| Mn | 0.0-0.4 wt % |

-continued

| | |
|---|---|
| Fe | 0.0-0.15 wt % |
| Si | 0.0-0.15 wt % |
| Zn | 0.0-1.8 wt % |
| Sb | 0.0-0.5 wt % |
| Zr | 0.0-0.5 wt % |
| Co | 0.0-0.5 wt % |
| Ti | hyperperitectic |
| Insoluble particles | 1.5-9.0 wt % |
| Al and inevitable impurities | Balance. |

10. An alloy according to claim 2 comprising:

| | |
|---|---|
| Cu | 4.2-5.0 wt % |
| Mg | 0.2-0.5 wt % |
| Ag | 0.45-0.85 wt % |
| Mn | 0.0-0.4 wt % |
| Fe | 0.0-0.15 wt % |
| Si | 0.0-0.15 wt % |
| Zn | 0.0-1.8 wt % |
| Sb | 0.0-0.5 wt % |
| Zr | 0.0-0.5 wt % |
| Co | 0.0-0.5 wt % |
| Ti | hyperperitectic |
| Insoluble particles | 4.0-9.0 wt % |
| Al and inevitable impurities | Balance. |

11. An alloy according to claim 1 wherein the insoluble particles are of a size which is at least in the region of an order of magnitude smaller than the dendrite arm spacing /grain size of the solid alloy, and occupy the interdendritic/intergranular regions of the alloy.

12. An alloy according to claim 11 wherein the insoluble particles have a particle size which lies in the range 0.5 to 25 μm.

13. An alloy according to claim 11 wherein the particle size lies in the range 0.5 to 15 μm.

14. An alloy according to claim 11 wherein the particle size lies in the range 0.5 to 5 μm.

15. An alloy according to claim 1 comprising 0.5 wt %-10 wt % titanium diboride particles.

16. An alloy according to claim 1 comprising 3 wt %-7 wt % titanium diboride particles.

17. An alloy according to claim 1 comprising 4 wt % titanium diboride particles.

18. An alloy according to claim 1 comprising 7 wt % titanium diboride particles.

19. A method of making a casting, comprising melting an aluminium copper alloy according to claim 1 and introducing the resulting alloy into a mold.

20. A method according to claim 19 comprising controlling the rate of cooling of the alloy in the mould.

21. A method according to claim 20 wherein the alloy comprises a hyperperitectic quantity of titanium, and the casting is made by one of sand casting or investment casting.

* * * * *